US010062531B1

(12) United States Patent
Peng

(10) Patent No.: US 10,062,531 B1
(45) Date of Patent: Aug. 28, 2018

(54) PLASTIC LAMPHOLDER WITH THERMOSTAT

(71) Applicant: Rich Brand Industries Limited, Dongguan, Guangdong Province (CN)

(72) Inventor: Te-Shui Peng, Taoyuan (TW)

(73) Assignee: Rich Brand Industries Limited, Dongguan (CN)

( * ) Notice: Subject to any disclaimer, the term of this patent is extended or adjusted under 35 U.S.C. 154(b) by 0 days.

(21) Appl. No.: 15/673,455

(22) Filed: Aug. 10, 2017

(51) Int. Cl.

| | |
|---|---|
| ***H01H 37/04*** | (2006.01) |
| ***H01H 37/68*** | (2006.01) |
| ***F21V 21/30*** | (2006.01) |
| ***H01R 33/22*** | (2006.01) |
| ***F25D 27/00*** | (2006.01) |
| ***H01R 33/46*** | (2006.01) |
| ***F21V 19/00*** | (2006.01) |

(52) U.S. Cl.
CPC ..... *H01H 37/68* (2013.01); *F21V 19/006* (2013.01); *F21V 21/30* (2013.01); *F25D 27/005* (2013.01); *H01H 37/04* (2013.01); *H01R 33/22* (2013.01); *H01R 33/46* (2013.01)

(58) Field of Classification Search
CPC .... F21V 19/0035; F21V 19/006; F21V 21/30; F25D 27/005; H01H 37/04; H01H 37/043; H01H 37/64; H01H 37/68; H01R 33/0863; H01R 33/0872; H01R 33/22; H01R 33/46
USPC ..... 337/298
See application file for complete search history.

(56) References Cited

U.S. PATENT DOCUMENTS

| | | | | | |
|---|---|---|---|---|---|
| 1,328,479 | A * | 1/1920 | Baker | H01H 71/16 | 337/113 |
| 4,131,868 | A * | 12/1978 | Dombrowski | H01R 33/95 | 337/113 |
| 4,396,898 | A * | 8/1983 | Tibolla | H01H 37/68 | 337/113 |
| 4,420,802 | A * | 12/1983 | Smester | F21S 8/02 | 362/145 |
| 4,450,512 | A * | 5/1984 | Kristofek | F21S 8/02 | 362/147 |
| 4,685,037 | A * | 8/1987 | Akiyama | F21V 21/04 | 337/113 |
| 4,751,623 | A * | 6/1988 | Gaines | F21S 8/035 | 315/74 |
| 9,768,571 | B1 * | 9/2017 | Peng | H01R 33/22 | |
| 9,793,668 | B1 * | 10/2017 | Peng | H01R 33/22 | |
| 2012/0127731 | A1 * | 5/2012 | Masuda | F21S 8/026 | 362/341 |

* cited by examiner

*Primary Examiner* — Zachary M Pape
*Assistant Examiner* — Jacob Crum
(74) *Attorney, Agent, or Firm* — Alan D. Kamrath; Kamrath IP Lawfirm, P.A.

(57) ABSTRACT

A plastic lampholder with a thermostat includes a housing, a plastic bracket, a plastic threaded ring, a positive electrode plate, a negative electrode plate, a thermostat and a top cover and is installed to a downlight. The lampholder has two slots for plugging two electrodes of a power line by a bare line section, so that a power source is introduced to the lampholder. Both of the plastic bracket and housing of the lampholder are made of a plastic material and integrally formed, and the plastic threaded ring of the lampholder is integrally formed in the housing. Power is conducted through a thermostat to prevent the lampholder from burning by high temperatures.

2 Claims, 7 Drawing Sheets

PLASTIC LAMPHOLDER WITH THERMOSTAT

BACKGROUND OF THE INVENTION

Field of the Invention

The present invention relates to a lampholder and, more particularly, to a plastic lampholder with a thermostat that can be manufactured, assembled and electrically connected more conveniently and that can timely disconnect the power at high temperatures to prevent the plastic lampholder from burning.

Description of the Related Art

Bright light is a driving force for improvements in all aspects of human activities. Without the invention of bright lights (such as light bulbs) and a series of subsequent improvements and modifications, human beings cannot have such rapid advancement in all aspects. The introduction of tungsten light bulbs was a great invention of mankind. In the principle of the tungsten light bulbs, the resistance of an electrical conduction is used to heat a tungsten filament to incandescence, to emit light. Since an amount of over 90% of the electric energy consumed by the tungsten light bulb is converted into heat energy, only an amount of 10% of the electric energy is used for emitting light. Obviously, the tungsten light bulbs have the drawbacks of high power consumption and low luminous efficiency. In recent years, government and private sectors of different countries in the world spare no effort to implement power saving and carbon reduction to maximize the utility of global resources and to protect the ecology and environment instead of overdeveloping them. Particularly, in the aspect of illumination, various different power-saving fluorescent light bulbs and LED light bulbs are developed to replace the traditional tungsten light bulbs having the drawbacks of high power consumption and low luminous efficiency.

In a home environment, there is a "downlight" generally installed and used at a home, and the downlight is a lamp embedded into a sealed ceiling. The conventional tungsten light bulb is generally installed in the downlight and is used for the purpose of illumination. Since the environment using the downlight is sealed and the tungsten light bulb generates much heat, the chance of burning the construction material such as the ceiling material becomes greater, and, thus, the downlight becomes a potential danger to the home environment. Therefore, the downlight is gradually replaced by a cold light illumination series. In other words, the power saving fluorescent light bulb and the LED light bulb are used as a light source to substitute the downlight.

The structure of a downlight is generally composed of a lamp body and a lampholder, and the lamp body is a shell object having an accommodating space formed therein. During assembling, the lamp body is embedded into an embedding hole formed on the ceiling to achieve the embedding and positioning effects. The bottom of the lamp body (that faces users) may be sealed by a cover or may be open without having a cover, and the top of the lamp body is opened and slightly tapered to form an accommodating slot. The lampholder can be installed, fixed, and positioned into the accommodating slot, and the lampholder is provided for connecting a power line at the top and connecting a light bulb at the bottom. Therefore, the downlight can emit light downwardly from the light bulb, and then scattered downwardly in a range surrounding the lamp body to provide illumination.

With reference for FIGS. 1 and 2 for a conventional lampholder 10 installed in a downlight, the conventional lampholder 10 is basically comprised of a housing 11, a metal bracket 12 and a metal threaded ring 13. The housing 11 is made of a high temperature resistant ceramic material and formed into a cylindrical shape. The top of the housing 11 is divided into positive and negative conductive lines 111 by screwing or riveting, and the bottom of the housing 11 is opened inwardly. The metal bracket 12 is made of a flexible metal steel and divided into a roof portion 121 and two elastic board parts 122 disposed on both sides of the metal bracket 12 respectively, and the roof portion 121 is fixed to the top of the housing 11 (by screwing or riveting) for the assembling. Thus, the two elastic board parts 122 are extended slantingly outwardly from both sides of the housing 11 (as shown FIG. 1). The metal threaded ring 13 is installed from the bottom of the housing 11 and coupled to the conductive line 111 of one of the electrode (negative electrode) of the metal threaded ring 13, so that the conductive line 111, the housing 11 and the metal threaded ring 13 are fixed to one another through the aforementioned screwing or riveting. The conductive line 111 of the other electrode (positive electrode) is coupled to a cathode conductive plate 112 by screwing or riveting (as shown in FIG. 1), and the cathode conductive plate 112 is independently situated within an open range at the top of the metal threaded ring 13.

After the downlight is assembled, the conventional lampholder 10 is installed and positioned in the accommodating slot at the top of the lamp body of a downlight. Thus, the elastic board parts 122 disposed on both sides of the metal bracket 12 is latched to the wall of the accommodating slot at the top of the lamp body, to achieve the effect of securely fixing the conventional lampholder 10 to the accommodating slot at the top the lamp body. When the whole downlight is installed to the ceiling, the lamp body of the downlight is embedded into the embedding hole formed on the ceiling, and the downlight is securely installed to the embedding hole by latching. Then, the conductive lines 111 are electrically connected and conducted with two electrodes of a power line connected to the mains power, so that a switch on the wall which is connected to the power lines may be used to control and turn on/off the power supply. Finally, the light bulb is installed by extending the light bulb from the bottom of the lamp body, and a threaded joint screw of the light bulb is installed and secured into the metal threaded ring 13 of the lampholder 10. Now, the top of the threaded joint screw of the light bulb abuts against the cathode conductive plate 112 to electrically conduct the conductive line 111 of the positive electrode, and the threaded portion of the threaded joint screw of the light bulb is electrically conducted with the conductive line 111 of the negative electrode through the metal threaded ring 13.

The conventional lampholder 10 is a product that has been in existence for a longtime, and its housing 11 is made of a high temperature resistant ceramic material to resist the large amount of heat generated by the tungsten light bulb. However, the power saving fluorescent light bulb and LED light bulb (cold light illumination series) are used as a light source of the downlight instead. In summation, the conventional lampholder 10 has the following drawbacks and requires improvements.

1. The conventional lampholder 10 must have the positive and negative conductive lines 111 connected to the top of the housing 11 by screwing or riveting, and the conductive lines 111 are electrically conducted with the electrodes of the power line of the mains power respectively. Such structure and connection method are complicated.

2. In the design of the conventional lampholder 10, the roof portion 121 of the metal bracket 12 and the top of the housing 11 are fixed by screwing or riveting, and such structure and connection method are also complicated.

3. In the design of the conventional lampholder 10, the metal threaded ring 13 and the housing 11 are connected, and, then, the metal threaded ring 13 carries the threaded joint screw of the light bulb. Such structure and connection method are also complicated.

4. The conventional lampholder 10 is not provided with a mechanism capable of disconnecting the power in high temperatures to avoid the initiation of burning and then damage the buildings. Even though the power saving fluorescent light bulb and the LED light bulb are used as a light source to substitute the downlight, it could hardly avoid the danger of high temperatures generated from breakdown. Furthermore, the potential danger still exists if somebody still uses the tungsten light bulb.

SUMMARY OF THE INVENTION

In view of the aforementioned drawbacks of the prior art, a plastic lampholder with a thermostat in accordance with the present invention overcomes the drawbacks of the prior art.

Therefore, it is a primary objective of the present invention to provide a plastic lampholder with a thermostat, which provides a convenient operation for connecting the power when the lampholder is installed to a downlight.

Another objective of the present invention is to provide a plastic lampholder with a thermostat, which provides a convenient operation of installing a housing and a plastic bracket when the lampholder is installed to a downlight.

A further objective of the present invention is to provide a plastic lampholder with a thermostat, which integrates a plastic threaded ring into a housing to provide a convenient way of assembling the plastic lampholder with the thermostat.

Another objective the present invention is to provide a plastic lampholder with a thermostat, which can disconnect the power at high temperatures to prevent the lampholder from burning.

To achieve the aforementioned and other objectives, the present invention discloses a plastic lampholder with a thermostat, and the lampholder comprises a housing, a plastic bracket, a plastic threaded ring, a positive electrode plate, a negative electrode plate, a thermostat and a top cover.

The housing is made of a plastic material, and has a bottom opening inwardly penetrating to form an accommodating space, a first through groove formed at an edge surface of the top of the housing and downwardly passed into the accommodating space, a carrying space formed on an inner side of the housing, and a group of accommodating slots formed on a side of the carrying space. A clamping slot is formed on a side of the other end surface of the top of the housing and communicated with one of the adjacent accommodating slots, and has a first channel and a first lower half slot formed on an inner side thereof. The first lower half slot is inwardly penetrated to form a first insert slot. The other side has a second through groove. A second channel and a second lower half slot are formed on the outer side thereof, and the second lower half slot is inwardly penetrated to form a second insert slot. A hollow spacer block is formed and protruded between the first lower half slot and the second lower half slot, and the second through groove is installed inside the spacer block. The periphery of the housing has a plurality of bumps provided for latching, and the housing has at least one vertical shallow groove concavely formed on a wall inside the accommodating space.

The plastic bracket and the housing are integrally formed and made of a plastic material, and two elastic plates are obliquely extended from both sides. The end of each plastic bracket has an engaging hook, and the joint of the plastic bracket and the housing is disposed between two bumps on the same side.

The plastic threaded ring is a threaded mark integrally formed on the internal wall of the accommodating space of the housing, and the plastic threaded ring breaks its extension at the position where the shallow groove is situated and recurs after passing through the shallow groove.

The positive electrode plate is made of an electrically conductive material and has a conductive protruding portion extending for a small section and then bent upwardly to form a vertical wall. The vertical wall has an electric connection plate and a first electric connection pole coupled to an end of the thermostat to achieve an electrical connection, and their connecting position is formed into a concave body. A second electric connection pole is coupled to the same end of the thermostat and the electric connection plate extending towards the front end surface to achieve the electric connection, and their connecting position is formed into a concave body. The front end of the electric connection plate is bent and extended inwardly and stamped to form a latch recess. The conductive protruding portion of the positive electrode plate is passed downwardly from the first through groove formed at the top of the housing into the accommodating space, until the vertical wall of the positive electrode plate cannot pass, so that the conductive protruding portion of the positive electrode plate is extended to the center of the top of the accommodating space.

The negative electrode plate is made of an electrically conductive material and has a conductive bent portion extending upwardly, bent inwardly into a limit plate, and further bent upwardly to form an electric connection plate, and whose lateral end is further bent, extended, and stamped to form a latch recess. The conductive bent portion of the negative electrode plate is extended into the spacer block and passed downwardly from the second through groove into the accommodating space of the housing, until the limit plate of the negative electrode plate is stopped by the housing. Now, the electric connection plate of the negative electrode plate abuts and stays at the internal wall of the spacer block. In the meantime, the plate body where the conductive bent portion of the negative electrode plate is located extends downwardly and stays in the shallow groove of the housing. Now, the extended and bent position of the electric connection plate is passed through the second channel and positioned, so that the latch recess stays in the second insert slot and aligns precisely with the second lower half slot.

The thermostat is installed in a carrying space of the housing correspondingly and coupled to the outwardly connected first electric connection pole and the electric connection plate coupled to the positive electrode plate on the vertical wall to form a concave body and received into and positioned by one of the accommodating slots. The second electric connection pole outwardly coupled to the thermostat and the electric connection plate extending towards the front end surface are coupled to form a concave body and is received and positioned by another accommodating slot. The forwardly extended electric connection plate is plugged and positioned into the clamping slot, and the bent section at the front end of the electric connection plate is passed and positioned into the first channel, so that the latch recess of the forwardly extended electric connection plate stays in the first insert slot and aligns precisely with the first lower half slot.

The top cover is covered onto the top of the housing. A first upper half slot is formed and configured to be corresponsive to the first lower half slot, and a second upper half slot is formed and configured to be corresponsive to the second lower half slot. A front limit baffle is formed at and extended downwardly from an edge of the first upper half slot and an edge of the second upper half slot separately. A spacer block is formed at the middle position, and a latch lever is installed at and extended downwardly from the periphery of the bottom of the top cover and configured to be corresponsive to the bump of the housing. The top cover corresponsive to the thermostat has a vent groove formed thereon. The top cover is pressed, such that the latch levers at the periphery of the top cover are configured to be corresponsive to the bumps of the housing respectively to achieve the latching effect, and the front limit baffles at edges on both sides of the top cover are corresponsive to the exterior of both sides of the front end of the housing. In the meantime, the first upper half slot and the first lower half slot are combined into a first slot, and the second upper half slot and the second lower half slot are combined into a second slot. The spacer block of the top cover presses into the spacer block of the housing. Meanwhile, the vent groove is disposed above the thermostat.

In the aforementioned plastic lampholder with a thermostat, the periphery of the first through groove of the housing has at least one positioning slot, and the bottom of the top cover has at least one downwardly extended positioning column configured to be corresponsive to the positioning slot. When the top cover is covered onto the top of the housing, the positioning columns are plugged and positioned into the positioning slots of the housing respectively.

DETAILED DESCRIPTION OF THE PREFERRED EMBODIMENTS

The technical characteristics, contents, advantages and effects of the present invention will be apparent with the detailed description of preferred embodiments accompanied with related drawings as follows.

Figure 6:
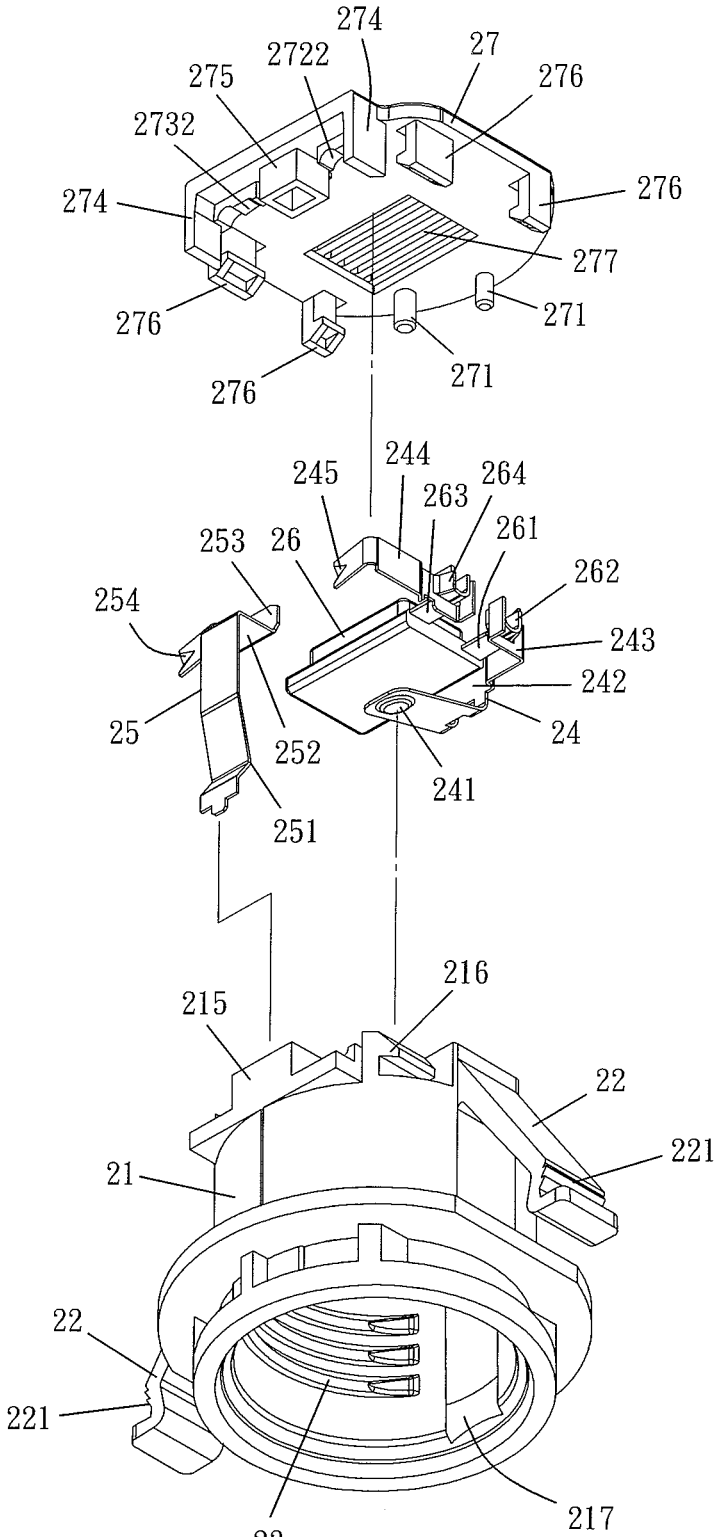
FIG. 6 is an exploded view of an embodiment of the present invention viewing from the bottom.
Figure 7:
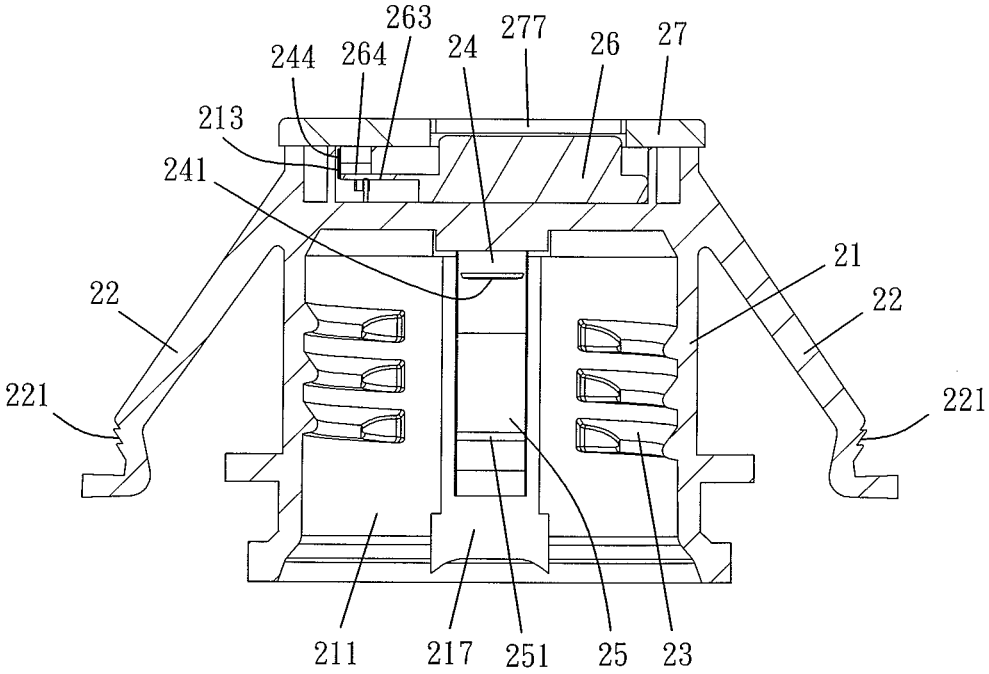
FIG. 7 is a sectional front view of an embodiment of the present invention.
Figure 8:
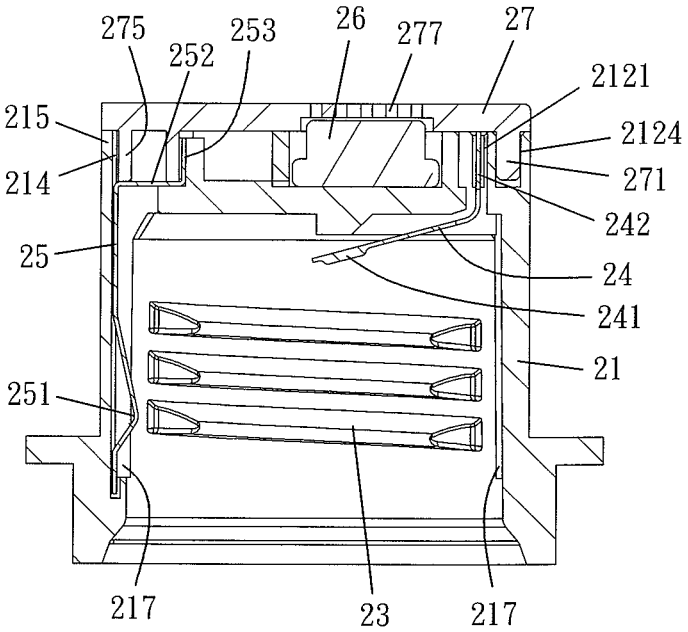
FIG. 8 is a sectional side view of an embodiment of the present invention.
Figure 9:
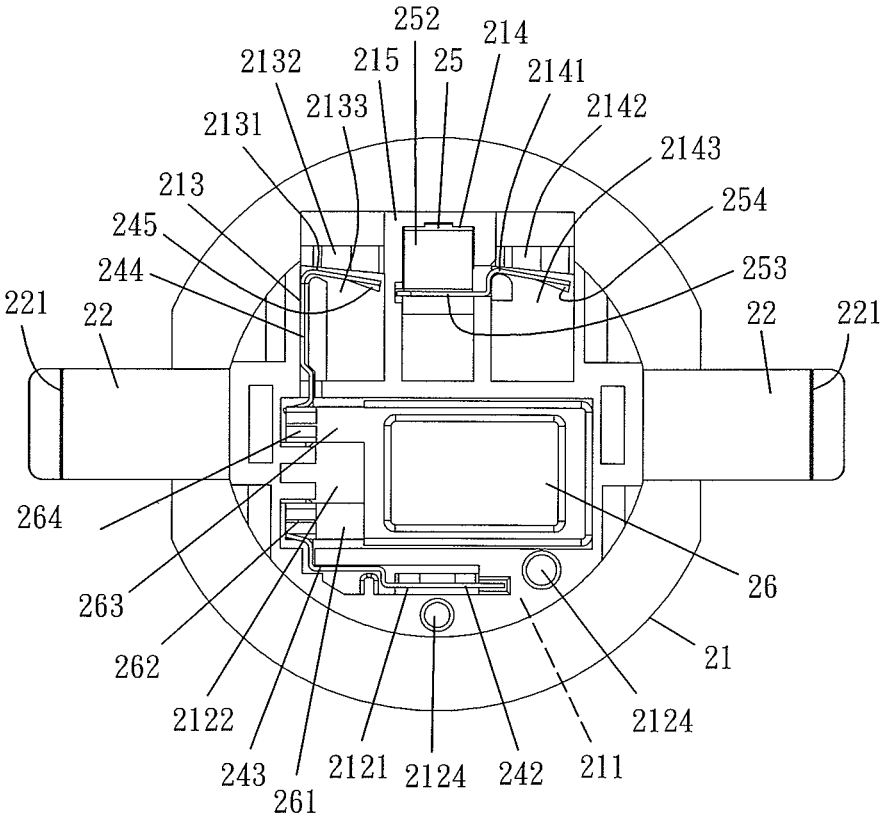
FIG. 9 is a top view of an embodiment of the present invention before a top cover is installed.

With reference to FIGS. 3~9 for a plastic lampholder 20 with a thermostat in accordance with a preferred embodiment of the present invention, the plastic lampholder 20 comprises a housing 21, a plastic bracket 22, a plastic threaded ring 23, a positive electrode plate 24, a negative electrode plate 25, a thermostat 26 and a top cover 27. The housing 21 is made of a plastic material and has a bottom opening inwardly penetrated to form an accommodating space 211, a first through groove 2121 formed at an edge of an end surface of the top of the housing 21 and downwardly communicated to the accommodating space 211, a carrying space 2122 formed on an inner side of the housing 21, a group of accommodating slots 2123 formed on an inner side of the carrying space 2122, and at least one positioning slot 2124 formed at the periphery of the first through groove 2121. A clamping slot 213 is reserved on a side of the other end surface of the top of the housing 21 and communicated adjacently with one of the accommodating slots 2123 and whose internal side has a first channel 2131 and a first lower half slot 2132. The first lower half slot 2132 is inwardly penetrated to form a first insert slot 2133. The other side has a second through groove 214 reserved thereon and whose outer side has a second channel 2141 and a second lower half slot 2142. The second lower half slot 2142 is inwardly penetrated to form a second insert slot 2143, and a hollow spacer block 215 is formed and protruded between the first lower half slot 2132 and the second lower half slot. Therefore, the second through groove 214 is concealed inside the spacer block 215 (as shown in FIG. 8. The periphery of the housing 21 has a plurality of bumps 216 provided for latching, and the housing 21 has at least one vertical shallow groove 217 concavely formed on the internal wall of the accommodating space 211 (as shown in FIGS. 6 and 8).

The plastic bracket 22 and the housing 21 are made of a plastic material and integrally formed and comprised of two elastic plates obliquely extended towards both sides. An end of each plastic bracket 22 has an engaging hook 221, and the joint of the plastic bracket 22 and the housing 21 is preferably arranged between the two bumps 216 on the same side, to achieve the effect of balancing the forces during the assembling process.

The plastic threaded ring 23 is a deep threaded notch formed on an internal wall of the accommodating space 211 of the housing 21 and integrally formed with the housing 21. However, the plastic threaded ring 23 is not formed at a position of the internal wall of the housing 21 where the vertical shallow groove 217 is formed (as shown in FIGS. 6 and 8). In other words, the plastic threaded ring 23 breaks its extension at the position where the vertical shallow groove 217 is situated and recurs after passing through the vertical shallow groove 217.

The positive electrode plate 24 is made of an electrically conductive material and has a conductive protruding portion 241, which is extended and bent for a small section to form a vertical wall 242. The vertical wall 242 is coupled to an electric connection plate 243 and a first electric connection pole 261 connected to an end of the thermostat 26 to achieve an electric connection, and whose connecting position is formed into a concave body 262. Then, the same end of the thermostat 26 is coupled to another second electric connection pole 263 and an electric connection plate 244 extending towards the front end surface to achieve the electric connection and whose connecting position is formed into a concave body 264. The front end of the electric connection plate 244 is further inwardly bent, extended, and stamped to form a latch recess 245.

The negative electrode plate 25 is made of an electrically conductive material and has a conductive bent portion 251, which extends upwardly, bent inwardly to form a limit plate 252, and further bent upwardly to form an electric connection plate 253, whose side end is further bent, extended, and stamped to form a latch recess 254.

The bottom of the thermostat 26 is expanded outwardly and precisely received into the carrying space 2122 of the housing 21. The thermostat 26 is extended outwardly and coupled to the first electric connection pole 261 and the second electric connection pole 263, so that the thermostat 26 and the electric connection plates 243, 244 achieve the electric connection. The connecting portion of the first electric connection pole 261 and the electric connection plate 243 form a concave body 262, and the connecting portion of the second electric connection pole 263 and the electric connection plate 244 form a concave body 264.

The top cover 27 is covered onto the top of the housing 21. At least one positioning column 271 is formed, downwardly extended, and configured to be corresponsive to the positioning slot 2124 of the housing 21. A first upper half slot 2722 is formed and configured to be corresponsive to the first lower half slot 2132, and a second upper half slot 2732 is formed and configured to be corresponsive to the second lower half slot 2142. A front limit baffle 274 is formed and extended downwardly from the edges of the first upper half slot 2722 and the second upper half slot 2732, and a spacer block 275 is formed in the middle of the first upper half slot 2722 and the second upper half slot 2732. The periphery of the bottom of the top cover 27 has a latch lever 276 extended downwardly and configured to be corresponsive to the bump 216 of the housing 21, and the top cover 27 has a vent groove 277 formed thereon and configured to be corresponsive to the thermostat 26.

During the assembling process, the conductive protruding portion 241 of the positive electrode plate 24 is passed downwardly from the first through groove 2121 at the top of the housing 21, so that the conductive protruding portion 241 is passed through the interior of the accommodating space 211, until the vertical wall 242 of the positive electrode plate 24 cannot pass. Now, the conductive protruding portion 241 of the positive electrode plate 24 is precisely extended to the middle of the upper part of the accommodating space 211 (as shown in FIG. 8). Then, the thermostat 26 is placed into the carrying space 2122 of the housing 21, and the first electric connection pole 261 and second electric connection pole 263 of the thermostat 26 are connected by the electric connection plate 243, 244 to achieve an electric connection. The concave bodies 262, 264 formed by the connecting positions are placed and positioned into the accommodating slot 2123. Then, the electric connection plate 244 is plugged into the clamping slot 213 and positioned, and the bent section at the front end of the electric connection plate 244 is passed through the first channel 2131, so that the latch recess 245 remains in the first insert slot 2133 and is aligned precisely with the first lower half slot 2132.

The conductive bent portion 251 of the negative electrode plate 25 is extended into the interior of the spacer block 215 and passed downwardly from the second through groove 214 until the limit plate 252 of the negative electrode plate 25 is blocked by the housing 21 and no longer can descend. Now, the electric connection plate 253 of the negative electrode plate 25 precisely abuts the internal of the spacer block 215 and remains there. In the meantime, the plate at the conductive bent portion 251 of the negative electrode plate 25 is downwardly extended and thus stays in the vertical shallow groove 217 of the housing 21 (as shown in FIG. 8). Now, the extended and bent position of the electric connection plate 253 is precisely passed through and positioned in the second channel 2141, so that the latch recess 254 stays in the second insert slot 2143 and aligns precisely with the second lower half slot 2142.

Figure 1:
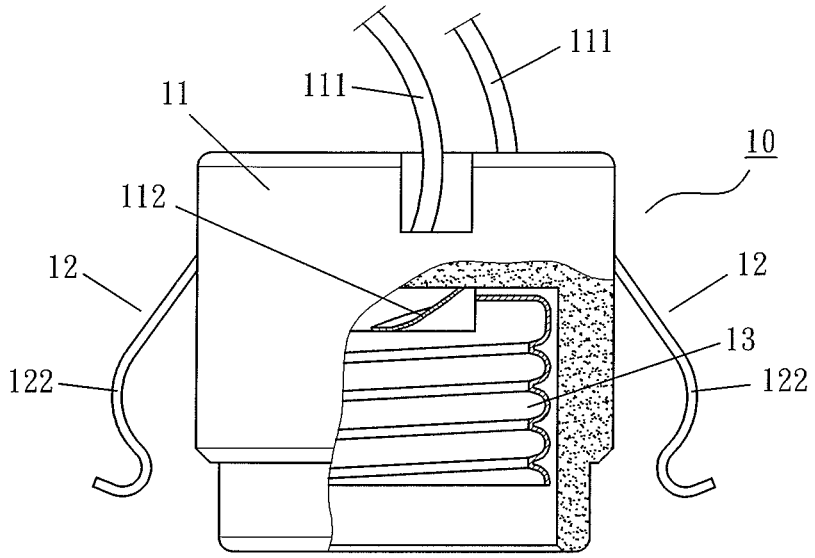
FIG. 1 (PRIOR ART)
FIG. 1 is a partial sectional side view of a conventional lampholder.
Figure 2:
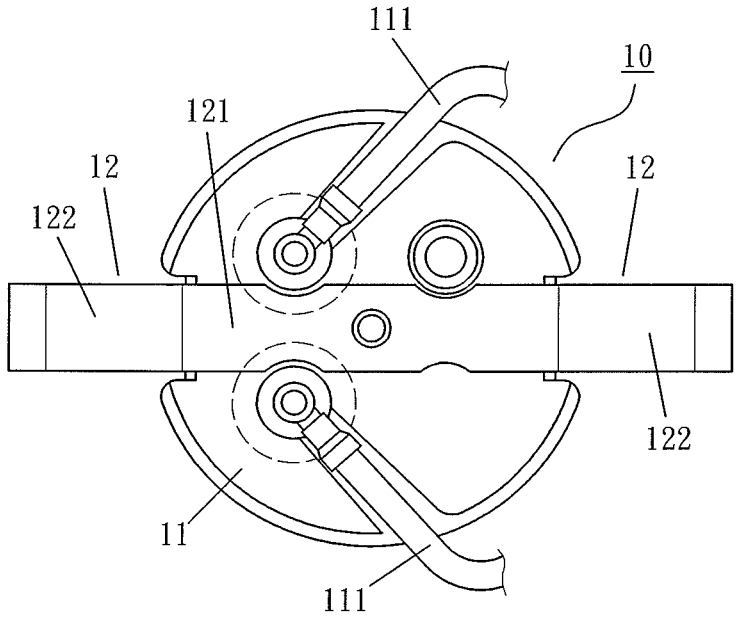
FIG. 2 (PRIOR ART)
FIG. 2 is a top view of a conventional lampholder.
Figure 3:
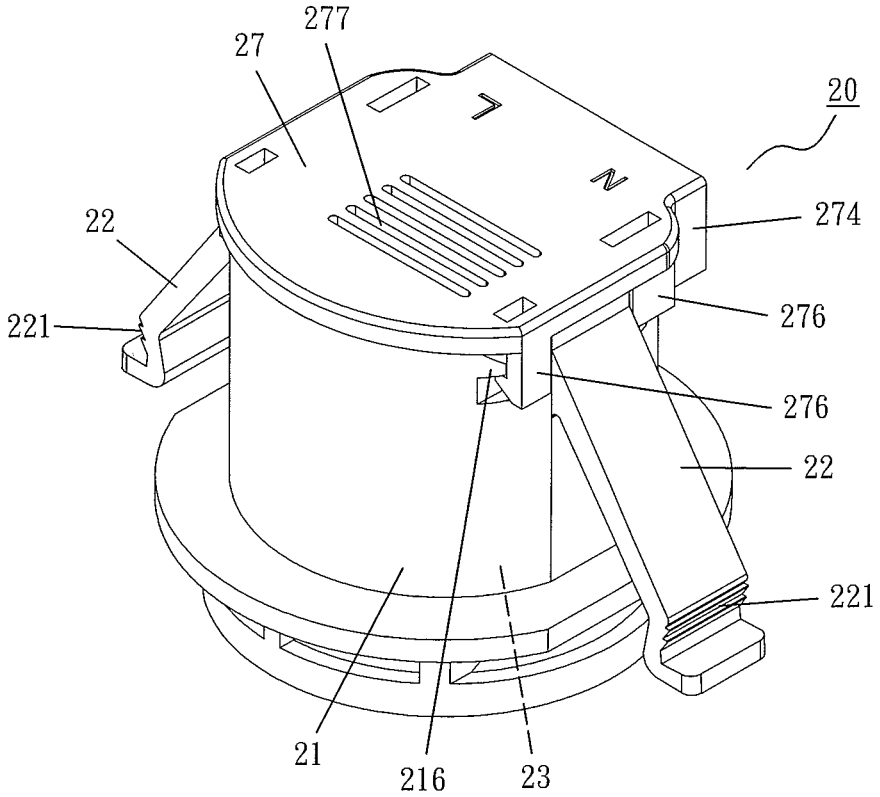
FIG. 3 is a perspective view of an embodiment of the present invention.
Figure 4:
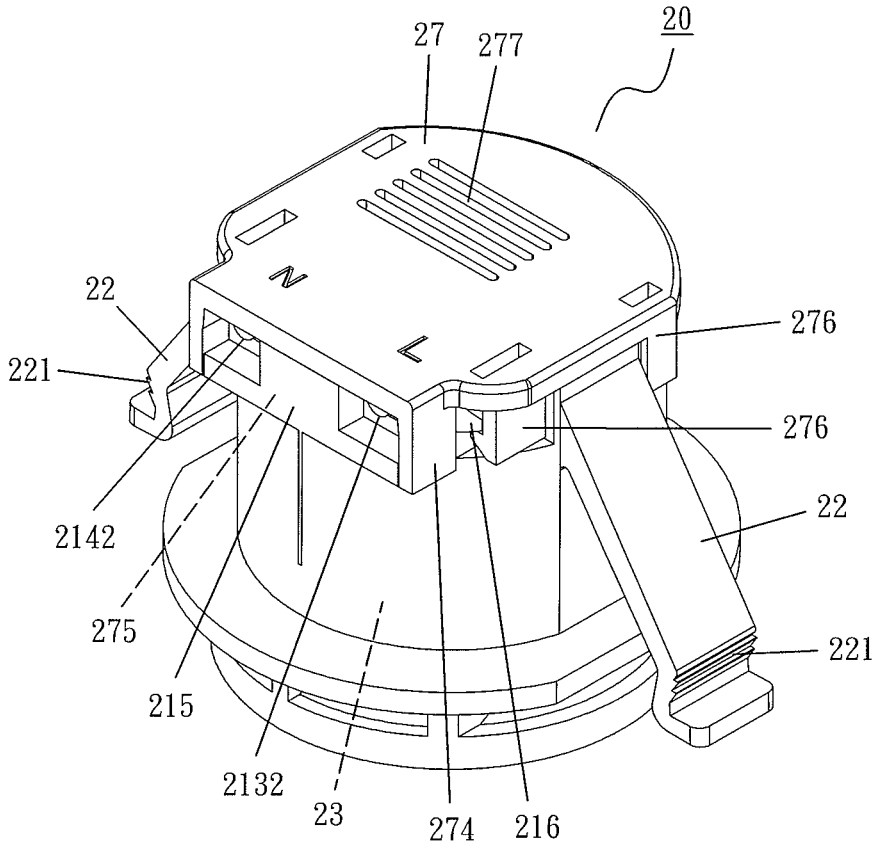
FIG. 4 is another perspective view of an embodiment of the present invention viewing from a different angle.
Figure 5:
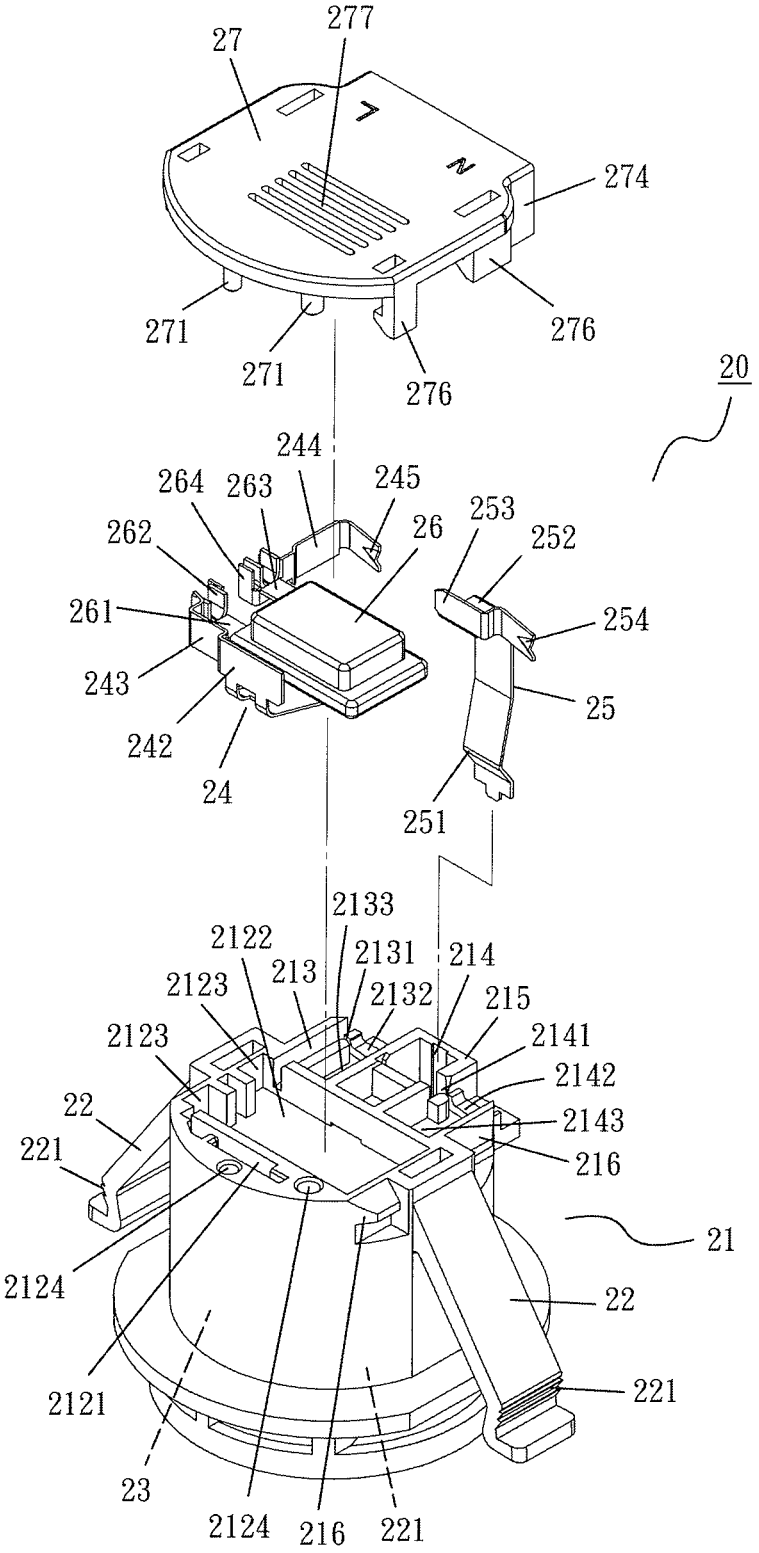
FIG. 5 is an exploded view of an embodiment of the present invention viewing from the top.

The top cover 27 is configured to be corresponsive to the top of the housing 21, so that the positioning columns 271 are configured to be corresponsive to the positioning slots 2124 of the housing 21 respectively. In the meantime, the front limit baffles 274 on both sides are configured to be corresponsive to the exterior of both sides of the front end of the housing 21. The top cover 27 is pressed, such that the latch levers 276 at the periphery of the top cover 27 can cross the bump 216 of the housing 21 and resume its original position, to achieve the effect of latching and connecting the top cover 27 with the housing 21 securely. During the process, the positioning columns 271 at the bottom of the top cover 27 are plugged and positioned in the positioning slot 2124 of the housing 21 respectively. The first upper half slot 2722 formed at the bottom of the top cover 27 will be coupled to the first lower half slot 2132 to form a first slot, and the second upper half slot 2732 will be coupled to the second lower half slot 2142 to form a second slot. In the meantime, the spacer block 275 will be pressed into the spacer block 215 of the housing 21 to reinforce the stability of the first slot and the second slot after the assembling and enhance the overall strength for receiving the plug. In the meantime, the vent groove 277 is situated precisely above the thermostat 26 (as shown in FIG. 8). Therefore, the whole assembly of the plastic lampholder 20 is completed. In the figure, the plastic bracket 22 is outwardly and obliquely extended from both sides of the housing 21 (as shown in FIGS. 3 and 4).

When the plastic lampholder 20 is assembled into the top accommodating slot of a lamp body of a downlight, the plastic brackets 22 disposed on both sides are extended and latched with the wall of the top accommodating slot of the lamp body, so that the plastic lampholder 20 and the top accommodating slot of the lamp body are coupled with each other securely.

After the plastic lampholder 20 and the lamp body are assembled into the downlight, the whole downlight can be installed to a ceiling for use. As long as the hard bare line sections of two electrodes of the power line connected to the mains are plugged into the first slot (comprised of the first upper half slot 2722 and the first lower half slot 2132) and the second slot (comprises of the second upper half slot 2732 and the second lower half slot 2142) respectively, the bare line sections of the two electrodes of the power line will touch the latch recess 245 of the electric connection plate 244 and the latch recess 254 of the electric connection plate 253. Then, a force is applied gently to press the bare line sections of the two electrodes of the power line further into the first slot and the second slot, so that the two bare line sections push and press the latch recess 245 of the electric connection plate 244 and the latch recess 254 of the electric connection plate 253 to bend inwardly, to allow the two bare line sections to touch and scratch the latch recess 245, 254 before entering into the first insert slot 2133 and the second insert slot 2143. After the applied force is released, the resilience of the electric connection plates 244, 253 clamps the latch recesses 245, 254 and the walls of the first insert slot 2133 and the second insert slot 2143 with the two bare line sections securely, so that the two electrodes of the power line of the mains will be conducted with the positive electrode plate 24 and negative electrode plate 25. Then, the threaded connector of a cold-light bulb (such as a power-saving fluorescent bulb or an LED bulb) is screwed into the plastic threaded ring 23 until the top end of the threaded connector presses deeply at the conductive protruding portion 241 of the positive electrode plate 24, so that the top end of the threaded connector is conducted with the positive electrode plate 24. In the meantime, the threaded portion of the threaded connector will be conducted with the conductive bent portion 251 of the negative electrode plate 25 in the plastic threaded ring 23 to light up the power-saving fluorescent bulb or LED bulb. The positive electrode plate 24 and the electric connection plate 244 are conducted to a power source through the thermostat 26. During a lighting process, the thermostat 26 can disconnect the power source timely to minimize the damage caused by high temperature if a certain part fails or for any other reason (such as using a tungsten filament bulb as the light source). Particularly, the thermostat 26 has a vent groove 277 formed at the top of the thermostat 26 for discharging heat to prevent the thermostat 26 from being over-sensitive and breaking down easily.

In summation of the description above, the assembly and use of the plastic lampholder 20 of the present invention simply require plugging the bare line sections of the two electrodes of the power line into the first slot and the second slot respectively in order to mount the plastic lampholder 20 without the need of screwing or riveting. Obviously, the operation is very convenient. Particularly, the plastic bracket 22 and the housing 21 are integrally formed and made of a plastic material, so that the manufacture is simpler and easier. In addition, the plastic threaded ring 23 is integrally formed inside the housing 21, so that the manufacture and assembling are more convenient.

Most importantly, the assembly conducts with the power through the thermostat 26, so that the power can be disconnected automatically when the plastic lampholder 20 is at a high temperature, to minimize the damage caused by high temperatures and achieve the objectives of the present invention.

While the invention has been described by way of specific embodiments, numerous modifications and variations could be made thereto by those skilled in the art without departing from the scope and spirit of the invention set forth in the claims.

What is claimed is:

1. A plastic lampholder comprising:

a housing made of a plastic material and having a bottom opening inwardly penetrating to form an accommodating space, a first through groove formed at an edge surface of a top of the housing and downwardly passed into the accommodating space, a carrying space formed on an inner side of the housing, a group of accommodating slots formed on a side of the carrying space, a clamping slot formed on a side of the top of the housing and communicated with one of adjacent accommodating slots and having a first channel and a first lower half slot;

with the first lower half slot inwardly penetrating to form a first insert slot, with another side of the top of the housing having a second through groove;

a second channel and a second lower half slot formed on an outer side of the housing;

with the second lower half slot inwardly penetrating to form a second insert slot;

a hollow spacer block formed and protruded between the first lower half slot and the second lower half slot, with the second through groove installed inside the hollow spacer block;

with a periphery of the housing having a plurality of bumps for latching, and with the housing having at least one vertical shallow groove concavely formed on a wall inside the accommodating space;

a plastic bracket and the housing integrally formed and made of a plastic material, with the plastic bracket comprising two elastic plates obliquely extending from both sides of the housing, with an end of each plastic bracket having an engaging hook, and with a joint of the plastic bracket and the housing disposed between two bumps on a same side of the housing;

a plastic threaded ring integrally formed on an internal wall of the accommodating space of the housing, with the plastic threaded ring breaking an extension at a position where the at least one vertical shallow groove is situated and recurring after passing through the at least one vertical shallow groove;

a thermostat;

a positive electrode plate made of an electrically conductive material and having a conductive protruding portion extending for a small section and bending upwardly to form a vertical wall, with the vertical wall having a first electric connection plate and a first electric connection pole coupled to a first end of the thermostat to achieve an electrical connection formed into a concave body;

a second electric connection pole coupled to the first end of the thermostat and the first electric connection plate to achieve an electric connection formed into a concave body, and with a front end of the first electric connection plate bending and extending inwardly and stamped to form a latch recess;

with the conductive protruding portion of the positive electrode plate passing downwardly from the first through groove formed at the top of the housing into the accommodating space until the vertical wall of the positive electrode plate cannot pass, and with the conductive protruding portion of the positive electrode plate extending to a center of a top of the accommodating space;

a negative electrode plate made of an electrically conductive material and having a conductive bent portion extending upwardly and bending inwardly into a limit plate and further bending upwardly to form a second electric connection plate, with a lateral end of the negative electrode plate further bending, extending and stamped to form a latch recess;

with the conductive bent portion of the negative electrode plate extending into the hollow spacer block and passing downwardly from the second through groove into the accommodating space of the housing until the limit plate of the negative electrode plate is stopped by the housing, with the second electric connection plate of the negative electrode plate abutting and staying at an internal wall of the hollow spacer block, with the conductive bent portion of the negative electrode plate extending downwardly and staying in the at least one vertical shallow groove of the housing, and with the second electric connection plate of the negative electrode plate passing through the second channel and positioned to make the latch recess of the negative electrode plate in the second insert slot and aligning precisely with the second lower half slot;

with the thermostat installed in a carrying space of the housing correspondingly and coupled to the first electric connection pole, and with the first electric connection plate of the positive electrode plate coupled to the positive electrode plate on the vertical wall to form a concave body and received into and positioned by one of the group of accommodating slots;

with the second electric connection pole outwardly coupled to the thermostat with the second electric connection plate of the negative electrode plate extending towards the front end surface to form a concave body and received and positioned by another of the group of accommodating slots, with the second electric connection plate plugged and positioned into the clamping slot, with the first electric connection plate passed and positioned into the first channel to make the latch recess of the first electric connection plate stay in the first insert slot and aligning precisely with the first lower half slot;

a top cover covered onto the top of the housing and including a first upper half slot formed and configured to be corresponsive to the first lower half slot, a second upper half slot formed and configured to be corresponsive to the second lower half slot, a front limit baffle formed at and extended downwardly from an edge of the first upper half slot and an edge of the second upper half slot separately, a spacer block formed at a middle position, and latch levers installed at and extended downwardly from a periphery of the top cover and configured to be corresponsive to the plurality of bumps of the housing, with the top cover corresponsive to the thermostat and having a vent groove formed thereon;

with the top cover being pressed with the latch levers at the top cover configured to be corresponsive to the plurality of bumps of the housing respectively to achieve a latching effect; and front limit baffles at edges on both sides of the top cover corresponsive to an exterior of both sides of the housing, with the first upper half slot and the first lower half slot being combined into a first slot and the second upper half slot and the second lower half slot being combined into a second slot, with the spacer block of the top cover pressing into the spacer block of the housing, and with the vent groove being disposed above the thermostat.

2. The plastic lampholder of claim 1, wherein the periphery of the first through groove of the housing having at least one position slot, with the top cover having at least one downwardly extended positioning column configured to be corresponsive to the at least one position slot, and with the at least one positioning column being plugged and positioned into the at least one positioning slot of the housing respectively when the top cover is covered onto the top of the housing.

* * * * *